US007476088B2

(12) United States Patent
Iimura et al.

(10) Patent No.: US 7,476,088 B2
(45) Date of Patent: Jan. 13, 2009

(54) AIR COMPRESSOR

(75) Inventors: Yoshio Iimura, Ibaraki (JP); Hiroaki Orikasa, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 437 days.

(21) Appl. No.: 11/258,018

(22) Filed: Oct. 26, 2005

(65) Prior Publication Data

US 2006/0110258 A1 May 25, 2006

(30) Foreign Application Priority Data

Oct. 27, 2004 (JP) ..... P2004-312056

(51) Int. Cl.
*F04B 49/06* (2006.01)

(52) U.S. Cl. ..... 417/44.2

(58) Field of Classification Search ..... 60/410, 60/329, 418, 409; 417/44.2–44.9, 20, 43
See application file for complete search history.

(56) References Cited

U.S. PATENT DOCUMENTS

2004/0191073 A1* 9/2004 Iimura et al. ..... 417/44.2

FOREIGN PATENT DOCUMENTS

| | | | |
|---|---|---|---|
| CN | 1534194 A | * | 10/2004 |
| CN | 1534419 A | | 10/2004 |
| JP | 11-280653 | | 10/1999 |

* cited by examiner

*Primary Examiner*—Devon C Kramer
*Assistant Examiner*—Vikansha S Dwivedi
(74) *Attorney, Agent, or Firm*—Mattingly, Stanger, Malur & Brundidge, P.C.

(57) ABSTRACT

A control circuit portion in an air compressor finds the rate of decrease of pressure inside a tank portion when a motor is at rest relative to the time based on a detection signal from a pressure sensor. Where the rate of decrease of pressure is greater than a given value, the motor is started without waiting for the pressure inside the tank to decrease to a motor restart pressure value, the pressure inside the tank portion rises to a given motor stop pressure value and the motor is then controlled to come to a stop. Where the rate of decrease of pressure is less than the given value, the motor is started when the pressure inside the tank has decreased to the motor restart pressure value. After the start of the motor, the motor is controlled such that it comes to a stop when the pressure inside the tank portion increases to a given value lower than the motor stop pressure value.

5 Claims, 5 Drawing Sheets

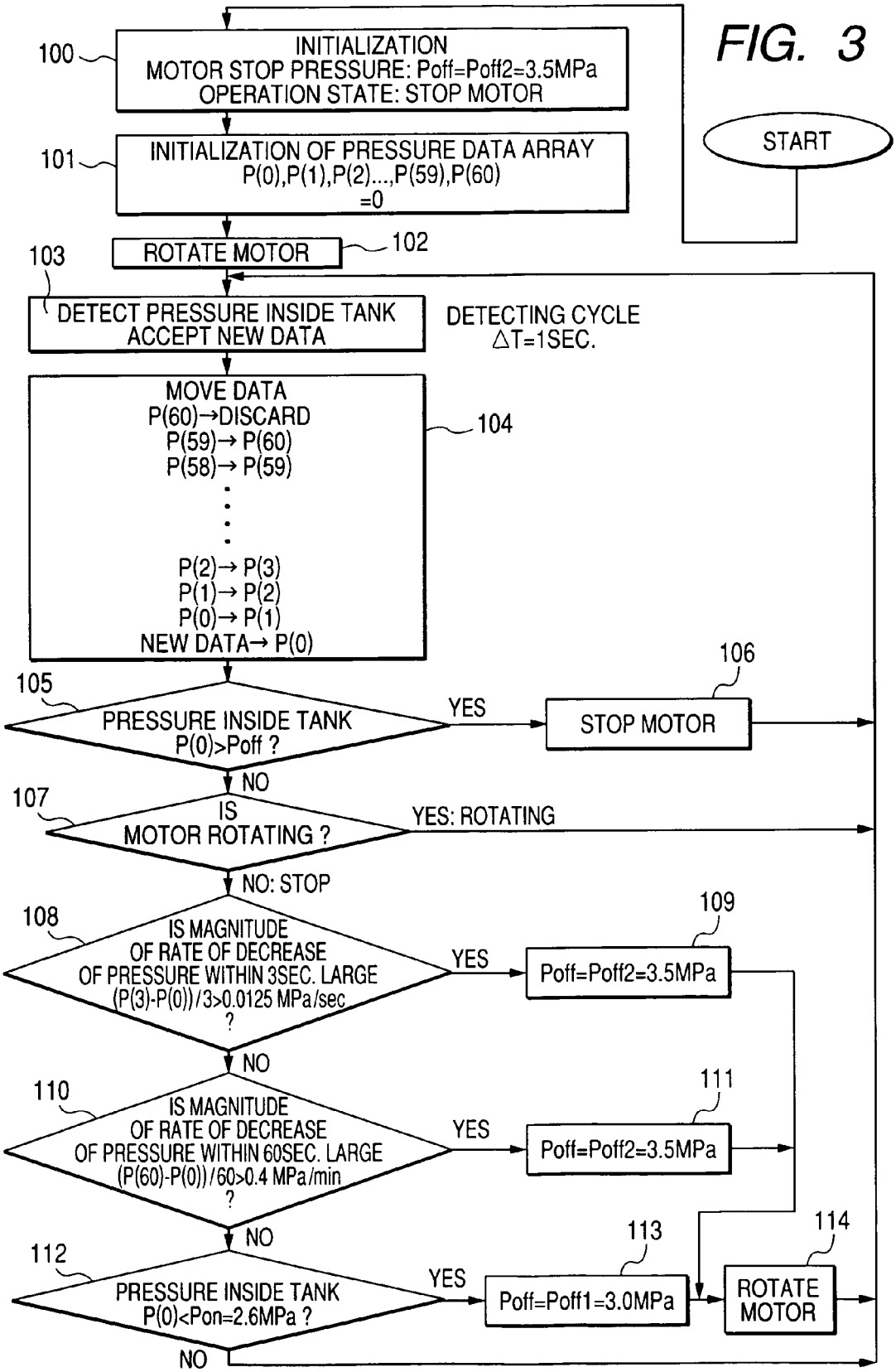
FIG. 3
START
100
INITIALIZATION
MOTOR STOP PRESSURE: Poff=Poff2=3.5MPa
OPERATION STATE: STOP MOTOR
101
INITIALIZATION OF PRESSURE DATA ARRAY
P(0),P(1),P(2)...,P(59),P(60)
=0
102
ROTATE MOTOR
103
DETECT PRESSURE INSIDE TANK
ACCEPT NEW DATA
DETECTING CYCLE
ΔT=1SEC.
104
MOVE DATA
P(60)→DISCARD
P(59)→ P(60)
P(58)→ P(59)
P(2)→ P(3)
P(1)→ P(2)
P(0)→ P(1)
NEW DATA→ P(0)
105
PRESSURE INSIDE TANK
P(0)>Poff ?
YES
106
STOP MOTOR
NO
107
IS
MOTOR ROTATING ?
YES: ROTATING
NO: STOP
108
IS MAGNITUDE
OF RATE OF DECREASE
OF PRESSURE WITHIN 3SEC. LARGE
(P(3)-P(0))/3>0.0125 MPa/sec
?
YES
109
Poff=Poff2=3.5MPa
NO
110
IS MAGNITUDE
OF RATE OF DECREASE
OF PRESSURE WITHIN 60SEC. LARGE
(P(60)-P(0))/60>0.4 MPa/min
?
YES
111
Poff=Poff2=3.5MPa
NO
112
PRESSURE INSIDE TANK
P(0)<Pon=2.6MPa ?
YES
113
Poff=Poff1=3.0MPa
114
ROTATE
MOTOR
NO

AIR COMPRESSOR

BACKGROUND OF THE INVENTION

1. Field of the Invention

The present invention relates to an air compressor for creating compressed air for driving a pneumatic tool such as a nailing machine.

2. Description of the Related Art

Generally, an air compressor for driving a pneumatic tool is designed to convert rotary motion of a motor into reciprocatory motion of a piston inside a cylinder via a crankshaft such that air sucked in from the suction valve of the cylinder is compressed by the reciprocatory motion of the piston. The air compressed within the cylinder is discharged into an air tank through a pipe from an exhaust valve and stored in the tank. A pneumatic tool such as a nailing machine operates by making use of the compressed air stored in the tank.

Such a conventional air compressor may be, in a rare case, of the stationary type having a large-sized air tank having a large capacity of creating compressed air. However, generally, air compressors are transported into building sites and run. Therefore, many of air compressors are portable types having relatively small-sized air tanks. Hence, there is a demand for an air compressor which has an air tank delivering a small amount of compressed air, i.e., relatively small capacity of producing compressed air, and which is minimal in size and has excellent portability.

Furthermore, an air compressor has a function of stopping the motor when the pressure inside the tank reaches a certain value that is an upper limit for safety reasons. Also, when the pressure inside the tank has decreased below a certain value that is a lower limit because of use of a pneumatic tool, the compressor restarts the motor. This function is accomplished by detecting the pressure inside the air tank by a pressure sensor and controllably turns on and off the power supply of the motor in response to the signal from the sensor.

FIG. 5 shows the pressure inside a tank for storing compressed air during operation of the prior art air compressor. In the graph of FIG. 5, the vertical axis indicates the pressure P (MPa) inside the tank, while the horizontal axis indicates the time T (min). Poff indicates a pressure at which the motor is stopped. Pon indicates a pressure at which the motor is restarted. PL indicates a work limit pressure at which the pneumatic tool such as a nailing machine is made inoperative due to a decrease of the pressure inside the tank.

In this prior art technique, the motor restart pressure Pon is so set that a certain extent of difference is produced between this pressure Pon and the motor stop pressure Poff. For example, this value is set such that $Pon<(0.9\times Poff)$, for the following reason. The motor comes to a stop at the point of the motor stop pressure Poff. Then, the pressure inside the tank mildly drops because of decrease of the temperature inside the tank and air leakage. Therefore, where the difference between Poff and Pon is small, the motor repeatedly and frequently starts and stops alternately even if no pneumatic tool is used. This state of oscillation should be prevented.

In FIG. 5, if the motor is started under the condition where no compressed air is consumed and the pressure inside the tank is zero, the pressure inside the tank rises. When the motor stop pressure Poff is reached at point a, the motor comes to a stop. If a pneumatic tool consuming only a small amount of compressed air is used continuously immediately after the stop of the motor, the pressure inside the tank drops relatively mildly and reaches the motor restart pressure Pon at point b, at which time the motor is restarted. The pressure inside the tank again increases and reaches the motor stop pressure Poff at point c, at which time the motor comes to a stop. Immediately after stop of the motor at the point c, if a pneumatic tool consuming a large amount of compressed air is used continuously, the pressure inside the tank drops rapidly and reaches Pon at point d. At this point, the motor is restarted. In the case of a small-sized portable compressor, however, the amount of created compressed air cannot catch up with the amount of consumption and so the pressure inside the tank keeps dropping. At last, the pressure reaches the work limit pressure PL at point e, where the work can no longer be continued. In this case, the work is interrupted, and the next work must be performed after waiting for the pressure inside the tank to rise.

In the prior art, a technique consisting of setting the motor stop pressure Poff to a higher value to increase the amount of usable compressed air has been adopted to solve the above-described problem.

For example, in an air compressor having a tank capacity of 10 liters, if the work limit pressure PL is 2.0 MPa, the amount of usable air (converted into atmospheric pressure) varies (or, increases) from 100 liters to 150 liters when the motor stop pressure Poff is increased from 3.0 MPa to 3.5 MPa. That is, the amount of usable air can be increased by 50% by increasing the motor stop pressure Poff from 3.0 MPa to 3.5 MPa.

SUMMARY OF THE INVENTION

However, with the prior art small-sized air compressor, if the motor stop pressure Poff is increased, the pressure inside the cylinder for creating compressed air increases. Therefore, the frictional force between the inner wall of the cylinder and the piston ring increases. Furthermore, the driving torque of the piston for creating compressed air increases. This increases the loads that bearings such as ball bearings and needle bearings used in the motor undergo.

Therefore, in the prior art technique, if one attempts to improve the continuous operable time of a pneumatic tool consuming a large amount of compressed air by increasing the amount of usable air, which is enabled by increasing the motor stop pressure Poff of the pressure inside the tank, there arises the problem that the life of the air compressor shortens.

Accordingly, it is an object of the present invention to provide a technique for controlling a motor that drives a compressed air creation portion which deteriorates neither the life nor the performance of an air compressor.

It is another object of the invention to provide an air compressor which is especially of the portable type and which permits elongation of the continuous operable time of a pneumatic tool connected with the air compressor by increasing the motor stop pressure (Poff) of compressed air stored in the tank.

The foregoing and other objects and novel features of the present invention will become more apparent from the following description of the present specification and accompanying drawings.

Typical embodiments of the present invention disclosed herein are summarily described in the following.

(1) An air compressor of the present invention has: a tank portion for storing compressed air; a compressed air creation portion for creating the compressed air and supplying it into the tank portion; a driver portion having a motor for driving the compressed air creation portion; a control circuit portion for controlling the driver portion; and a pressure sensor for detecting the pressure of the compressed air inside the tank portion. The control circuit portion controls the driver portion based on a detection signal from the pressure sensor in such a way as to stop the motor when the pressure inside the tank portion has increased to a given motor stop pressure value (Poff) and start the motor when, after stopping the motor, the pressure inside the tank portion has decreased to a given motor restart pressure value (Pon). In a case where the rate of decrease of pressure (ΔP/ΔT) is less than a given value, the motor is stopped before the pressure inside the tank portion reaches the motor stop pressure value.

(2) Another air compressor of the invention is based on the air compressor of item (1) above and further characterized in that in a case where the rate of decrease of pressure is greater than the given value, the motor is started without waiting for the pressure inside the tank portion to decrease to the motor restart pressure value.

(3) A further air compressor of the invention is based on the air compressor of item (2) above and further characterized in that the rate of decrease of pressure is given by a first rate of decrease of pressure (ΔP1/ΔT1) inside the tank portion within a first time (ΔT1) and by a second rate of decrease of pressure (ΔP2/ΔT2) inside the tank portion within a second time (ΔT2) longer than the first time. The first rate of decrease of pressure is compared with a first given value or the second rate of decrease of pressure is compared with a second given value. In a case where any one of the first and second rates of decrease of pressure is greater than the first or second given value, the motor is controlled to start without waiting for the pressure inside the tank portion to decrease to the motor restart pressure value. The motor is controlled to come to a stop when the pressure inside the tank portion has increased to the motor stop pressure value after the start of the motor.

(4) A yet other air compressor of the invention is based on item (3) above and further characterized in that the first given value is a rate of decrease of pressure having a value greater than the second given value.

According to the above-described features of the present invention, in a case where the rate of decrease of pressure of the compressed air inside the tank portion is greater than the given value, the motor is immediately started. When the pressure inside the tank portion has increased to the given motor stop pressure value (Poff), the motor is stopped. On the other hand, in a case where the rate of decrease of pressure is below the given value, the motor is started when the pressure of the compressed air inside the tank portion has decreased to a given motor restart pressure value (Pon). When the pressure of the compressed air inside the tank portion has increased to a given pressure value that is lower than the motor stop pressure value (Poff), the motor is controlled to come to a stop. Accordingly, when the amount of consumption of the compressed air is small, the motor driving is stopped under high-pressure conditions by lowering the motor stop pressure. As a result, the wear of the inner wall of the cylinder of the driver portion and of the piston ring and load on the bearing portions can be reduced. The life of the air compressor can be prolonged.

According to the feature of the invention of the above-described item (3), a state in which the amount of air consumption is relatively large can be detected at early times by the rate of decrease of pressure (ΔP1/ΔT1) within a relatively short time. On the other hand, a relatively large pressure decrease (ΔP2) that cannot be detected within a short time (ΔT1) such as in a case where a pneumatic tool is used at intervals can be detected by means of the rate of decrease of the pressure (ΔP2/ΔT2) over a relatively long time (ΔT2). Consequently, the pressure can be controlled efficiently.

BRIEF DESCRIPTION OF THE DRAWINGS

FIG. 3 is a flowchart showing one embodiment of a program used to control an air compressor associated with the invention;

DETAILED DESCRIPTION OF THE PREFFERED EMBODIMENTS

Embodiments of the present invention are hereinafter described in detail with reference to FIGS. 1-4. In all the figures illustrating the embodiments, members having the same function are indicated by the same numeral and their repeated description is not provided.

Figure 1:
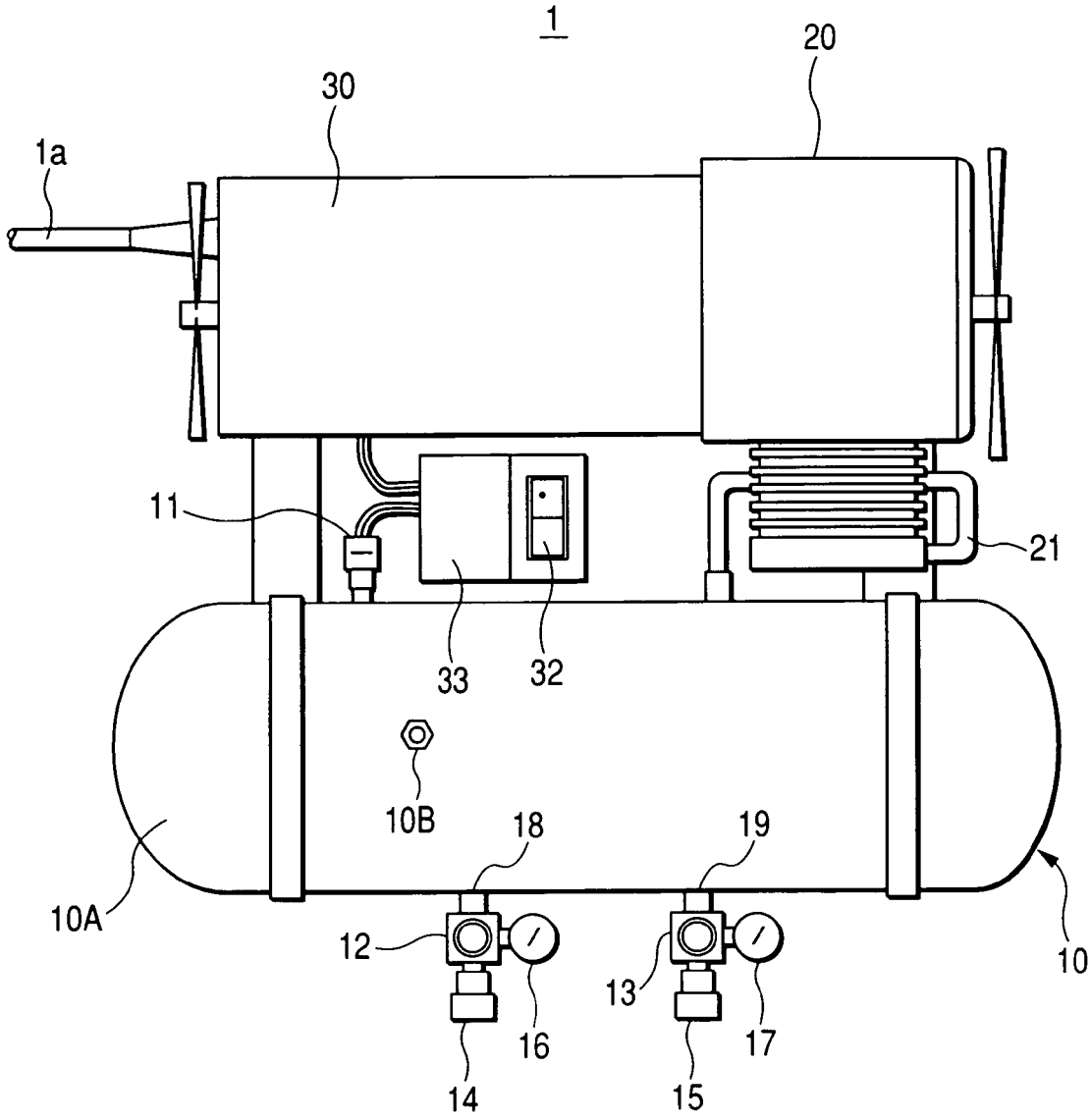
FIG. 1 is a front elevation showing the outer appearance of one embodiment of an air compressor associated with the present invention.
Figure 2:
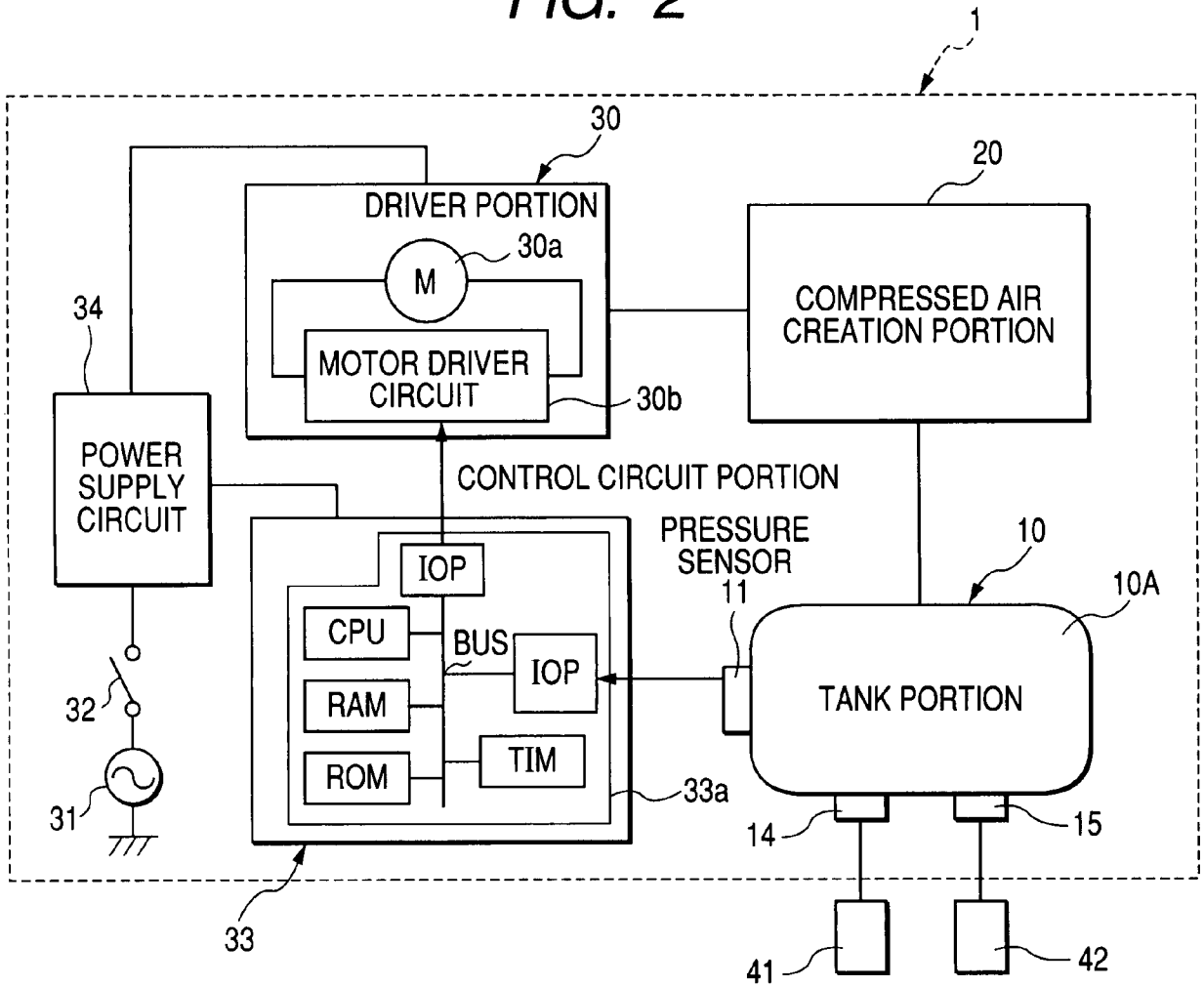
FIG. 2 is a block diagram showing one embodiment of an air compressor associated with the invention.

FIG. 1 is a front elevation showing the outer appearance of an air compressor of the present invention. FIG. 2 is a block diagram showing the electrical and mechanical systems according to the air compressor of the invention.

As shown in FIG. 1, an air compressor 1 associated with the present invention has a tank portion 10 for storing compressed air, a pressure sensor 11 for detecting the pressure of compressed air inside the tank portion 10, a compressed air creation portion 20 for creating the compressed air, a driver portion 30 having a motor 30*a* (see FIG. 2) for driving the compressed air creation portion 20, and a control circuit portion 33 for controlling start and stop (turning on and off) of the motor 30*a* of the driver portion 30, the control circuit portion 33 being constituted within an enclosure.

The tank portion 10 is made up of a pair of cylindrical tanks 10A arranged parallel to each other in a direction crossing the plane of the paper, and acts to store compressed air. The compressed air is created by the compressed air creation portion 20 and supplied into the tanks 10A through a pipe (air circulation passage) 21 from the delivery port of the compressed air creation portion 20. The supplied compressed air has a pressure, for example of 2.0 to 3.5 MPa within the tanks 10A.

A safety valve 10B is mounted to a part of each tank 10A. When the pressure inside each tank 10A becomes excessively high, a part of the compressed air is discharged to the outside to prevent excessive pressure increase. The tank 10A is provided with a pair of compressed air takeout ports 18 and 19, which are connected with couplers (fluid couplings) 14 and 15 via pressure-reducing valves 12 and 13, respectively. Pneumatic tools 41 and 42 (see FIG. 2) such as nailing machines are connected with the couplers 14 and 15, respectively, by air hoses.

The pressure-reducing valves 12 and 13 have a function of suppressing the maximum pressure of the compressed air on the exit side (coupler side) to a certain level irrespective of the magnitude of the pressure of the compressed air on the entrance side (tank side). For example, where pressure-reducing valves having a maximum pressure of 2.0 MPa are used as the pressure-reducing valves 12 and 13, the pressure-reducing valves 12 and 13 deliver only compressed air of less than 2.0 MPa even if the pressure of the compressed air inside the tank 10A is higher than 2.0 MPa. Accordingly, compressed air having a pressure less than the maximum pressure is obtained from the exit side of the pressure-reducing valves 12 and 13 irrespective of the pressure inside the tank 10A.

Pressure gauges 16 and 17 are mounted to the pressure-reducing valves 12 and 13, respectively, such that the pressures on the exit sides of the pressure-reducing valves 12 and 13 can be monitored.

The pressure sensor 11 is mounted to a part of each tank 10A to detect the pressure of compressed air inside the tank 10A. The detection signal is sent to the control circuit portion 33 (described later) to control a motor driver circuit 30*b* for starting or stopping the motor 30*a* of the driver portion 30 shown in FIG. 2.

The compressed air creation portion 20 is designed to convert rotary motion of the motor 30*a* into reciprocatory motion and to reciprocate a piston (not shown), for creating compressed air. That is, the piston is reciprocated within the cylinder to compress air drawn into the cylinder from the intake valve of the cylinder, thus processing the compressed air. The compressed air is discharged into the pipe 21 from an exhaust valve mounted in the cylinder head and is stored into the tank 10A through the pipe 21. For example, a technique disclosed in JP-A-11-280653 filed by the same applicant as the applicant of the present application can be applied to the structure of the compressed air creation portion (body of the compressor).

Commercial AC power (e.g., single-phase AC power of 100 V and 50/60 Hz) 31 is supplied to the air compressor 1 via a power cord 1*a*.

In the block diagram of the air compressor shown in FIG. 2, the commercial power 31 is supplied to a power supply circuit 34 via a main switch 32. The power supply circuit 34 includes a rectifier circuit for rectifying the AC power 31 and supplies DC power to the control circuit portion 33 and to the driver portion 30.

The motor 30*a* equipped in the driver portion 30 consists, for example, of a DC motor. The motor 30*a* is driven by the motor driver circuit 30*b*. The motor driver circuit 30*b* is controlled by the control circuit portion 33. If the motor driver circuit 30*b* is turned on by the control circuit portion 33, the motor 30*a* is started. Conversely, if the motor driver circuit 30*b* is turned off, the motor 30*a* is controlled to come to a stop.

The control circuit portion 33 is made of a microcomputer 33*a*. This microcomputer 33*a* is composed of functional blocks of a central processing unit (CPU) for executing calculations and a control program, a read-only memory (ROM) for storing the control program for the CPU, a random access memory (RAM) used as the working area for the CPU and a temporal storage area for data, a timer (TIM), and input-output ports (IOP). These are interconnected by an internal bus (BUS). A well-known IC (integrated circuit) fabricated on a semiconductor substrate by the semiconductor integrated circuit fabrication technology can be applied to the configuration itself of the functional blocks of the microcomputer 33*a*.

The detection signal from the pressure sensor 11 mounted to the tank 10A is applied to the input-output ports (IOP) of the microcomputer 33*a*. The motor driver circuit 30*b* is controlled by the CPU based on the control program loaded in the ROM and on the data stored in the RAM. Thus, the motor 30*a* is started or stopped (i.e., turned on or off).

The program set in the control circuit portion 33 (microcomputer 33*a*) for operating the air compressor is next described by referring to the flowchart shown in FIG. 3.

The main switch 32 (see FIG. 2) is turned on to start the air compressor. Then, control goes to step 100.

First, in step 100, initialization is performed. The motor driver circuit 30*b* is turned off to bring the motor 30*a* to a stop. The motor stop pressure Poff2 that is the motor stop pressure of the pressure inside the tank 10A is set to 3.5 MPa (Poff2 = 3.5 MPa).

Next, in step 101, pressure detected by the pressure sensor 11 varies every second until a period of 60 seconds passes and results in 61 pressure data items P(0)-P(60) which are stored in the RAM. The pressure data items are cleared to an initial value of 0. The array of the pressure data items P(0)-P(60) in the memory is used to calculate, every second, the rate of decrease of pressure ($\Delta P1/\Delta T1$) within a period of 3 seconds and the rate of decrease of pressure ($\Delta P2/\Delta T2$) within a period of 60 seconds as described later. That is, they are used to discriminate between three cases: (1) a large amount of compressed air inside the tank 10A is consumed in a short time when the motor is at rest; (2) a relatively large amount of compressed air is consumed over a longtime; and (3) the amount of consumption of the compressed air is small. When initialization of the data array in step 101 is completed, the motor 30*a* is rotated in step 102.

In step 103, the pressure of the compressed air inside the tank 10A is detected every second. The new data is successively accepted into the array of the pressure data items P(0)-P(60) in the memory.

In step 104, the pressure data items are moved within the array of the pressure data items P(0)-P(60) connected in series within the memory. That is, the data item stored in the final address P(60) of the data array in the memory is discarded. The data item stored in the memory address P(59) is moved into the memory address P(60). The data item stored in the memory address P(58) is moved into the memory address P(59). Similarly, the data item stored in the memory address P(0) is moved into the memory address P(1). A new data item is stored in the memory address P(0).

In step 105, a decision is made as to whether the newest pressure inside the tank 10A which is stored at the memory location P(0) is higher than the motor stop pressure Poff. If the decision is YES, i.e., P(0)>Poff, control goes to step 106, where the motor 30*a* is set to stop. Then, control returns to step 103. Conversely, if the decision is NO, i.e., P(0)≦Poff, the state of operation of the motor is judged in step 107.

In step 107, if the motor 30*a* is rotating (the decision is YES), control returns to step 103. Conversely, if the decision is NO (the motor is at rest), control goes to step 108.

In step 108, the magnitude of the rate of decrease of pressure within a short time of 3 seconds is judged. If the decision is YES, i.e., the rate of decrease of pressure (P(3)−P(0))/3>0.0125 MPa/sec, it is determined that the compressed air inside the tank 10A is consumed in large amount. Therefore, to increase the amount of air stored in the tank 10A, the motor stop pressure Poff is set equal to 3.5 MPa (Poff2=3.5 MPa) in step 109. In step 114, the motor 30*a* at rest is rotated. Control then returns to step 103.

If the decision in step 108 is NO, i.e., the rate of decrease of pressure (P(3)−P(0))/3≦0.0125 MPa/sec, it is determined that the amount of compressed air consumed in a short time is small. However, the amount of consumption over a long time might be large. Therefore, in step 110, the magnitude of the rate of decrease of pressure over a long time of 60 seconds is judged.

In step 110, if the decision is YES, i.e., if the rate of decrease of pressure over a long time is (P(60)−P(0))/60>0.4 MPa/min (=0.0067 MPa/sec), it is considered that the amount of consumed compressed air is large and so the motor stop pressure Poff is set such that the relationship Poff2=3.5 MPa in step 111 to increase the amount of air stored in the tank 10A. In step 114, the motor at rest is rotated. Control then returns to step 103.

If the decision in step 110 is NO, i.e., the rate of decrease of pressure over a long time is (P(60)−P(0))/60≦0.4 MPa/min (=0.0067 MPa/sec), it is considered that the amount of consumed air is small. Therefore, in step 112, a decision is made as to whether the pressure P(0) inside the tank 10A has decreased to the motor restart pressure Pon=2.6 MPa.

The decision made in step 112 is YES, i.e., the pressure inside the tank 10A has decreased below the motor restart pressure Pon=2.6 MPa. Therefore, in step 113, the motor stop pressure Poff is set to a given value Poff1=3.0 MPa lower than the motor stop pressure value Poff2=3.5 MPa. In step 114, the motor 30*a* at rest is rotated. Control returns to step 103. The reason why the motor stop pressure Poff is set to the given value Poff1=3.0 MPa lower than Poff2=3.5 MPa is as follows. In a case where the amount of consumed compressed air is small, it is determined that no problem will be produced even if the amount of air stored in the tank 10A is small. Wasteful load on the piston ring is avoided by lowering the motor stop pressure Poff. Thus, the life of the air compressor is prolonged.

If the decision made in step 110 is NO, i.e., if the pressure inside the tank is greater than the motor restart pressure Pon=2.6 MPa, it is determined that the amount of compressed air is neither excess nor insufficient. Therefore, no processing is performed and control returns to step 103.

Figure 4:
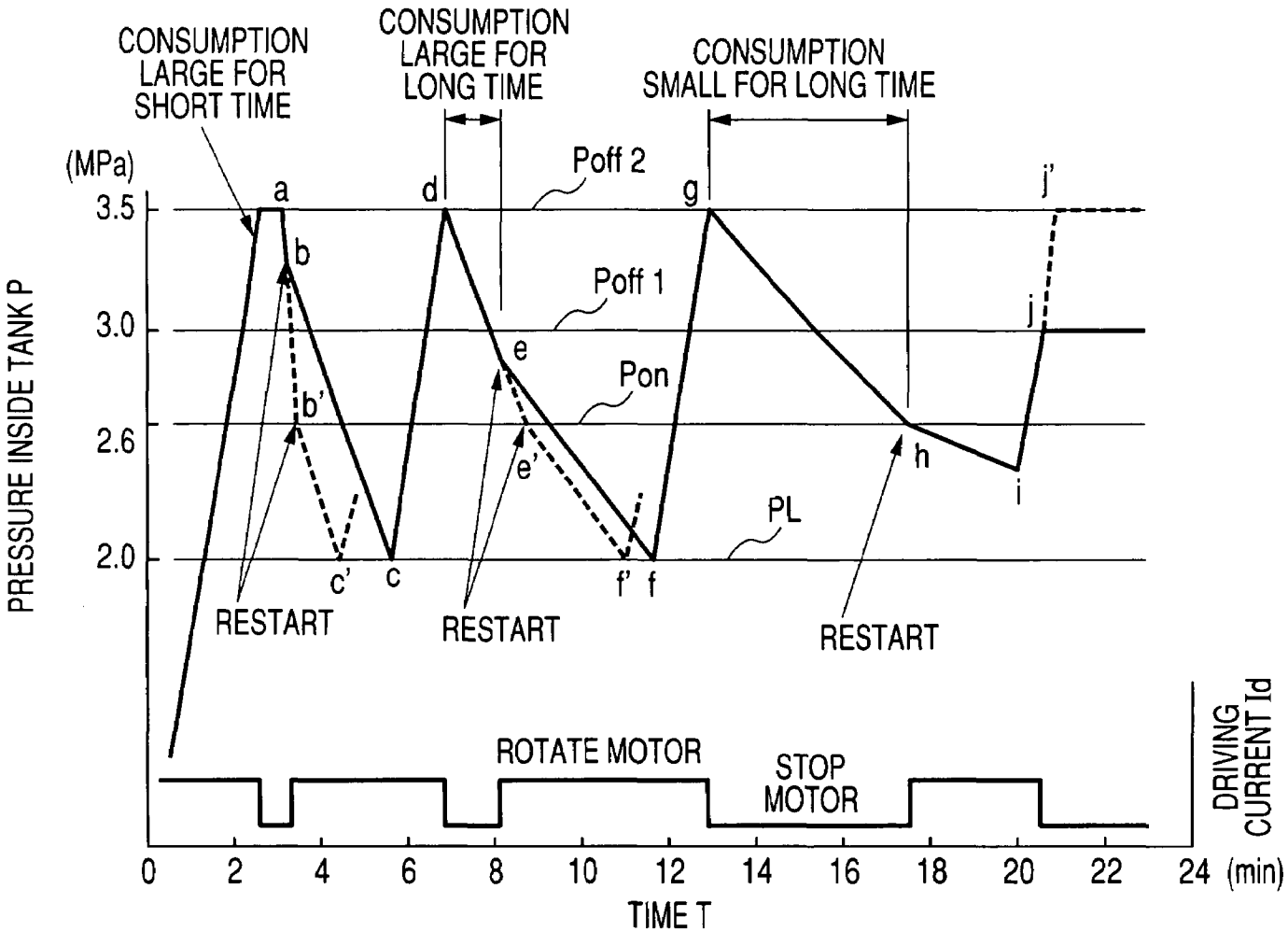
FIG. 4 is a pressure variation curve illustrating the operation of one embodiment of an air compressor associated with the invention.

An example of operation of the air compressor according to the above-described flowchart (see FIG. 3) is next described by referring to FIG. 4. In FIG. 4, the pressure of compressed air (pressure inside the tank) P (MPa) inside the tank 10A and driving current Id flowing through the motor 30*a* are plotted on the vertical axis. The time T (min) is plotted on the horizontal axis.

In FIG. 4, Poff1 and Poff2 indicate the motor stop pressures already described in connection with FIG. 3. That is, as described previously, in a case where the amount of consumed compressed air is relatively large and the rate of decrease of pressure (ΔP/ΔT) of the compressed air inside the tank 10A decreases at a rate greater than a given rate, the pressure is increased by rotation (start) of the motor 30*a*. When the pressure of the compressed air inside the tank 10A reaches a preset value, the motor 30*a* must be stopped. Given values of the pressure at which the motor is stopped in this way are the motor stop pressures Poff1 and Poff2. The motor stop pressure Poff2 is set to 3.5 MPa. The motor stop pressure Poff1 is set to a value of 3.0 MPa that is lower than Poff2=3.5 MPa.

Meanwhile, Pon indicates the motor restart pressure. That is, in a case where the amount of consumed compressed air is relatively small and the rate of decrease of pressure (ΔP/ΔT) of the compressed air inside the tank 10A decreases at a rate less than a given rate, the machine waits without starting the motor 30*a* until the pressure of the compressed air inside the tank 10A decreases to a given value that is the motor restart pressure. Then, the motor 30*a* is started. The given value of the pressure at which the motor is started in this way is the motor restart pressure Pon. As described previously, the motor restart pressure Pon is set equal to 2.6 MPa (Pon=2.6 MPa).

PL indicates the work limit pressure. That is, it indicates the limit value at which the pressure of the compressed air inside the tank 10A is used for a pneumatic tool such as a nailing machine. In the pneumatic tool of the present embodiment, the work limit pressure PL is set equal to 2.0 MPa (PL=2.0 MPa).

In FIG. 4, variation of the pressure inside the tank occurring with the elapse of time and indicated by the broken line indicates the characteristics obtained by the prior art method in which control is provided without detecting the rate of decrease of pressure (ΔP/ΔT).

In FIG. 4, the state assumed at point a is that the pressure P of the compressed air inside the tank 10A has increased to Poff2=3.5 MPa and the motor 30*a* has stopped.

Figure 5:
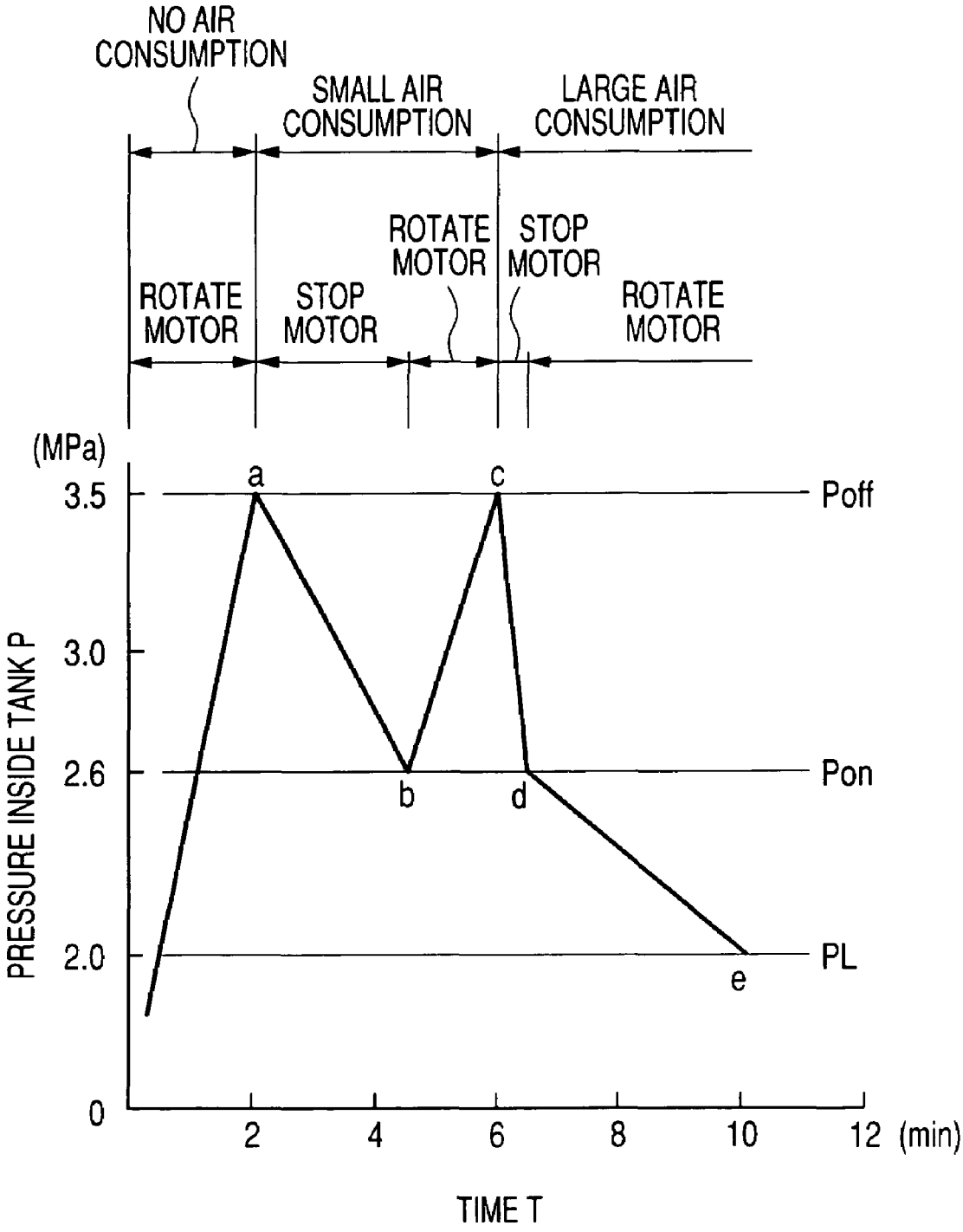
FIG. 5 is a pressure variation curve illustrating the operation of an air compressor associated with a prior-art example.

A case in which nails having a large diameter are started to be driven in continuously from the point a, for example, by a nailing machine consuming a relatively large amount of compressed air within a short time is now discussed. Since compressed air is consumed in large amount, the pressure inside the tank drops rapidly. In this case, when the prior art control method as shown in FIG. 5 is followed, control is provided neglecting the rate of decrease of pressure (ΔP/ΔT) of the pressure inside the tank during consumption. Therefore, the pressure inside the tank rapidly drops from the point a to point b'. At the point b', the motor restart pressure Pon is reached. At this time, the motor 30*a* is restarted. Accordingly, decrease of the pressure inside the tank is mitigated but the phenomenon of pressure decrease still persists. At point c', the work limit pressure PL is reached. At this time, the nailing machine can no longer be used. Consequently, the continuous operable time of the nailing machine consuming a large amount of compressed air within a short time varies from point a to c'.

On the other hand, where the rate of decrease of pressure (ΔP/ΔT) inside the tank is detected and control is provided according to the control method of the present invention shown in FIG. 3, the rate of decrease of pressure (ΔP1/ΔT1) (=(P(3) −P(0))/3) within a short time of 3 seconds between points a and b is detected. Where this short-time rate of decrease of pressure (ΔP1/ΔT1) is greater than a given value of 0.0125 MPa/sec, i.e., (P(3)−P(0))/3>0.0125 MPa/sec, the control circuit portion 33 sets the motor stop pressure Poff to 3.5 MPa (Poff2=3.5 MPa). After detecting the rate of decrease of pressure, the motor 30*a* is immediately restarted at the point b. This advances the starting time of the motor 30*a*, mitigating the rate of decrease of pressure. The time at which the pressure decreases to the work limit pressure PL is the point c. Decrease of the pressure inside the tank is mitigated as indicated by the solid line b-c. The work time available until the pressure decreases to the work limit pressure PL (2.0 MPa) can be prolonged.

In this way, according to the present invention, the motor 30*a* is restarted immediately after a large decrease in the pressure of the compressed air inside the tank 10A is detected. Therefore, decrease of the pressure inside the tank is mitigated from that point on. Consequently, the continuous operable time can be made much longer than the prior art case where the pressure decreases along the broken line b'-c' although the pressure inside the tank reaches the work limit pressure PL along the solid line b-c.

Then, at point d, if continuous nailing of nails having a medium diameter by a nailing machine consuming a relatively large amount of compressed air over a long time is started, the compressed air is consumed in large amount over a long time though the amount of consumption is smaller than indicated by the above-described points a-b-c. Consequently, the pressure inside the tank decreases rapidly. With the prior art method shown in FIG. 5, control is provided without detecting the rate of decrease of pressure (ΔP/ΔT) of the pressure inside the tank and so the pressure inside the tank rapidly drops from point d to point e'. At the point e', the motor restart pressure Pon is reached, whereupon the motor 30*a* is restarted. Accordingly, the phenomenon of pressure decrease still persists though the decrease of the pressure inside the tank is mitigated. At point f', the work limit pressure PL is reached and the nailing machine can no longer be used. Therefore, in this case, the continuous operable time persists from point d to f'.

On the other hand, where control is provided while detecting the rate of decrease of pressure (ΔP/ΔT) of the pressure inside the tank according to the control method of the present invention shown in FIG. 3, the rate of decrease of pressure (ΔP2/ΔT2)(=(P(60)−P(0))/60) over a long time of 60 seconds between points d and e is detected. Where the rate of decrease of pressure (ΔP2/ΔT2) within this long time is greater than a given value of 0.4 MPa/min (=0.0067 MPa/sec), i.e., in the case (ΔP2/ΔT2) =((P(60)-P(0))/60>0.4 MPa/min (=0.0067 MPa/sec), the control circuit portion 33 sets the motor stop pressure Poff to 3.5 MPa (Poff2=3.5 MPa). Immediately thereafter, the motor 30*a* is restarted at the point e.

Consequently, the starting time of the motor 30*a* is advanced. This mitigates decrease of the pressure inside the tank as along the solid line e-f. That is, if a relatively large decrease in the pressure of the compressed air inside the tank is detected, the motor 30*a* is immediately restarted. Decrease of the pressure inside the tank is mitigated from that point on. Accordingly, the continuous operable time can be made longer than in the prior art case of pressure drop occurring along the broken line e'-f', though the decreasing pressure inside the tank occurring along the solid line e-f reaches the work limit pressure PL.

Then, if continuous nailing of nails having a small diameter, for example, by a nailing machine with a relatively small amount of continuous consumption of compressed air is started at point g, the amount of consumed compressed air is small and so the pressure inside the tank mildly decreases. In this case, the rate of decrease of pressure (ΔP1/ΔT1) of the pressure inside the tank within a short time and the rate of decrease of pressure (ΔP2/ΔT2) of the pressure over a long time are smaller than given values of 0.0125 MPa/sec and 0.4 MPa/min (=0.0067 MPa/sec), respectively. The pressure inside the tank drops from point g to point h in the same way as in the prior art method in which control is provided without detecting the rate of decrease of pressure (ΔP/ΔT). The pressure inside the tank reaches the motor restart pressure Pon=2.6 MPa at the point h. At this time, the motor 30*a* is restarted. Consequently, decrease of the pressure inside the tank is mitigated. The nailing operation ends at point i. Then, the pressure inside the tank rapidly increases. After the end of the work, the pressure inside the tank is increased by restart of the motor. When the pressure reaches a given value, the motor is stopped. According to the present invention, the motor stop pressure Poff at which the motor 30*a* is stopped is set to a value of 3.0 MPa (Poff1=3.0 MPa) lower than the prior art value of Poff2=3.5 MPa. For example, this value is set to a value that is 0.8 to 0.9 times Poff2.

That is, in the prior art method in which the rate of decrease of pressure (ΔP/ΔT) inside the tank is not detected at g-h, the motor stop pressure Poff is uniquely set to 3.5 MPa (Poff2=3.5 MPa) irrespective of the magnitude of the rate of decrease of the pressure. Therefore, the motor is stopped at point j' when the pressure inside the tank reaches 3.5 MPa. On the other hand, according to the present invention, the rate of decrease of pressure (ΔP1/ΔT1) within a short time and the rate of decrease of pressure (ΔP2/ΔT2) over a long time are detected. If the rates of decrease of pressure are judged to be less than the given values, the motor 30*a* is restarted at point h. The motor stop pressure is reset. The motor stop pressure Poff is modified to Poff1=3.0 MPa. Therefore, when the pressure inside the tank reaches 3.0 MPa at the point j, the motor is stopped. Therefore, where the amount of consumed compressed air inside the tank 10A is small, the air compressor is run at a low pressure. In consequence, the wear of the cylinder and the load on the bearings are reduced. The life of the air compressor can be prolonged.

As is obvious from the embodiment of the present invention described so far, according to the air compressor of the invention, the control circuit portion detects the rate of decrease of the pressure of the compressed air inside the tank. Where the amount of consumed compressed air is small, i.e., the rate of decrease of the pressure is smaller than a given value, the motor stop pressure (Poff) is automatically reset to a value of Poff1 that is lower than Poff2. Therefore, the load on the air compressor is alleviated. The life can be prolonged.

Furthermore, according to the present invention, in a case where the amount of consumed compressed air is large, i.e., where the rate of decrease of pressure of the compressed air inside the tank is large, the motor is immediately restarted. Also, the motor stop pressure (Poff) is reset to a value of Poff2 that is larger than the Poff1 used where the amount of consumed compressed air is small. Consequently, the continuous operable time of the pneumatic tool such as a nailing machine connected with the air compressor can be prolonged. Where the present invention is especially applied to a small-sized portable air compressor in this way, excellent advantages can be obtained.

While the invention made by the present inventor has been particularly described so far based on the embodiment, the invention is not limited thereto. Rather, various changes and modifications are possible without departing from the scope of the gist of the invention.

In the above-described embodiment, the time for which the rate of decrease of pressure (ΔP1/ΔT1) within a short time is detected is set to 3 seconds. The time may also be set to other time of less than 3 seconds. On the other hand, the time for which the rate of decrease of pressure (ΔP2/ΔT2) over a long time is detected is set to 60 seconds. It may also be set to other time that is longer or shorter than 60 seconds according to the amount of compressed air consumed by the pneumatic tool or the work time. Furthermore, control may be provided based on a single rate of decrease of pressure without using both short-time and long-time rates of decrease of pressure.

In addition, the given value (reference value) against which the detected rate of decrease of pressure is compared may be set to other given value, taking account of the tank capacity of the air compressor and the capability of producing compressed air or the amount of compressed air consumed by the pneumatic tool and the work time.

What is claimed is:

1. An air compressor comprising:

a tank portion for storing compressed air;

a compressed air creation portion for creating the compressed air and supplying it into the tank portion;

a driver portion having a motor for driving the compressed air creation portion;

a control circuit portion for controlling the driver portion; and a pressure sensor for detecting pressure of the compressed air inside the tank portion;

wherein the control circuit portion controls the driver portion based on a detection signal from the pressure sensor in such a way as to stop the motor when the pressure inside the tank portion has increased to a given motor stop pressure value and start the motor when the pressure inside the tank portion has decreased to a given motor restart pressure value after the motor has stopped; and wherein if a rate of decrease of the pressure detected in the tank portion is less than a given value, then the motor is stopped before the pressure inside the tank portion reaches the motor stop pressure value.

2. An air compressor as set forth in claim 1, wherein in a case where the rate of decrease of the pressure is greater than the given value, the motor is started without waiting for the pressure inside the tank portion to decrease to the motor restart pressure value.

3. An air compressor as set forth in claim 2, wherein the rate of decrease of the pressure is given by a first rate of decrease of pressure ($\Delta P1/\Delta T1$) inside the tank portion within a first time ($\Delta T1$) and by a second rate of decrease of pressure ($\Delta P2/\Delta T2$) inside the tank portion within a second time ($\Delta T2$) longer than the first time, wherein the first rate of decrease of pressure is compared with a first given value or the second rate of decrease of pressure is compared with a second given value, wherein in a case where any one of the first and second rates of decrease of pressure is greater than the first or second given value, the motor is started without waiting for the pressure inside the tank portion to decrease to the motor restart pressure value, and wherein the motor is stopped when the pressure inside the tank portion has increased to the motor stop pressure value after the start of the motor.

4. An air compressor as set forth in claim 3, wherein the first given value is a rate of decrease of pressure having a value greater than the second given value.

5. An air compressor comprising:

a tank portion for storing compressed air;

a compressed air creation portion for creating the compressed air and supplying it into the tank portion;

a driver portion having a motor for driving the compressed air creation portion;

a control circuit portion for controlling the driver portion; and a pressure sensor for detecting pressure of the compressed air inside the tank portion, wherein the control circuit portion controls the driver portion based on a detection signal from the pressure sensor in such a way as to stop the motor when the pressure inside the tank portion has increased to a given motor stop pressure value and start the motor when the pressure inside the tank portion has decreased to a given motor restart pressure value after the motor has stopped, wherein based on the rate of decrease of the pressure, the control circuit portion selects the motor stop pressure value from at least two values, first motor stop pressure value and second motor stop pressure value which is less than the first stop pressure value, and wherein in a case where the rate of the decrease of the pressure detected in the tank portion is less than a predetermined value, the motor is stopped when the pressure inside the tank portion reaches the second motor stop pressure value, while in a case where the rate of the decrease of the pressure is more than the predetermined value, the motor is stopped when the pressure inside the tank portion reaches the first motor stop pressure value.

* * * * *